United States Patent [19]

Consorti

[11] 3,943,988

[45] Mar. 16, 1976

[54] LAUNDRY BAG

[76] Inventor: Sebastian John Consorti, 820 S. McClelland St., Santa Maria, Calif. 93454

[22] Filed: Feb. 21, 1975

[21] Appl. No.: 551,784

[52] U.S. Cl. ..... 150/7
[51] Int. Cl.[2] ..... B65D 33/16
[58] Field of Search ..... 150/7, 21, 22, 42, 49, 150/51

[56] References Cited

UNITED STATES PATENTS

| | | | |
|---|---|---|---|
| 777,263 | 12/1904 | Mead | 150/7 |
| 1,496,462 | 6/1924 | Hunt | 150/7 |
| 2,574,563 | 11/1951 | Hieb | 150/49 |
| 3,396,885 | 8/1968 | Giondi | 150/51 X |
| 3,831,650 | 8/1974 | Consorti | 150/7 |

*Primary Examiner*—Donald F. Norton
*Attorney, Agent, or Firm*—Christie, Parker & Hale

[57] ABSTRACT

A laundry bag has two flaps, one for directly overlying laundry and the second to overlie the first and close the bag. Side panels at right angles to the flaps also fold over laundry. The side and flaps join the body of the bag at a seam. This seam provides a natural fold for the sides and flaps to fold over the top of a hamper and hold the bag to the hamper. A band extends from the seam to stiffen the fold and reinforce the bag proximate the seam.

8 Claims, 5 Drawing Figures

LAUNDRY BAG

BACKGROUND OF THE INVENTION

The present invention relates to laundry containers in general and particularly to laundry bags.

Usually, commercial laundry bags have employed draw cords at their open ends to close the bags. As simple as the draw cord closure of laundry bags is, the technique has its drawbacks. To keep a bag closed, the ends of the cord must be tied. The knots are often difficult to untie, leading to the common practice of cutting the cord. This results in constant repair of the draw cords. The draw cords also wear out their housing sleeve in the bag, requiring repair in this area also.

In normal practice, commercial establishments such as hotels and restaurants employ laundry hampers which have a rim supported above a floor by legs. The laundry bag is attached to the hamper by folding the open end of the bag from inside the rim, over its top and down its outside. The draw cord is then drawn tight to prevent the laundry bag from pulling back over the rim. In other words, the open end of the laundry bag is turned inside out over the rim and the draw cord tightened to secure the bag to the hamper. If there is damage to the draw cord or sleeve it becomes difficult to properly mount the bag on a hamper. In addition, this construction does not limit the amount of laundry that can be stuffed into the bag. Too much laundry in a bag can split the bag's seams or make the bag difficult to handle.

An improvement over the draw cord laundry bag is described in U.S. Pat. No. 3,831,650. This patent provides a means for properly limiting the capacity of the bag and to secure the contents of the bag for handling in a laundry.

SUMMARY OF THE INVENTION

The present invention provides a laundry bag having first and second flaps at an open end. The first flap folds over laundry and the second flap folds over the first and is secured to the body of the bag, as by a strap.

The flaps include lateral panels which also overlie laundry. The flaps join the body of the bag at a circumferential seam. A reinforcing and stiffening band of doubled-over material of the flaps joins the body of the bag at the seam.

The bag is adapted for use with a laundry hamper, typically of the well known X-frame type. This type of hamper has two parallel, upper cross bars to hold a bag. The bag of the present invention folds over the cross bars of the hamper at the circumferential seam with the band, flaps and side panels being on the outside of the bars and the balance of the bag being on the inside of the bars. The flaps form a taught skirt on the outside of the hamper which securely holds the bag to the hamper. The natural fold at the seam determines the capacity of the bag, for it is here where the flaps and skirt inevitably fold over the bars.

These and other features, aspects and advantages of the present invention will become more apparent from the following description, appended claims and drawings.

DESCRIPTION OF THE PREFERRED EMBODIMENTS

Figure 1:
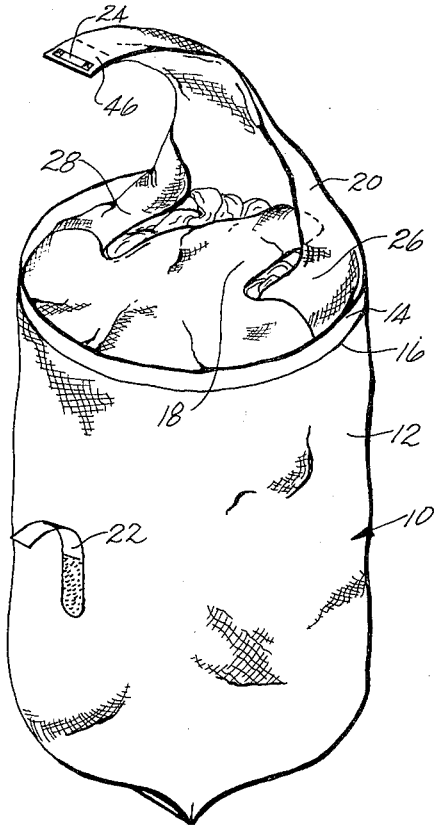
FIG. 1 is a perspective view of a laundry bag in accordance with the present invention full of laundry with the flaps of the bag being closed.
Figure 2:
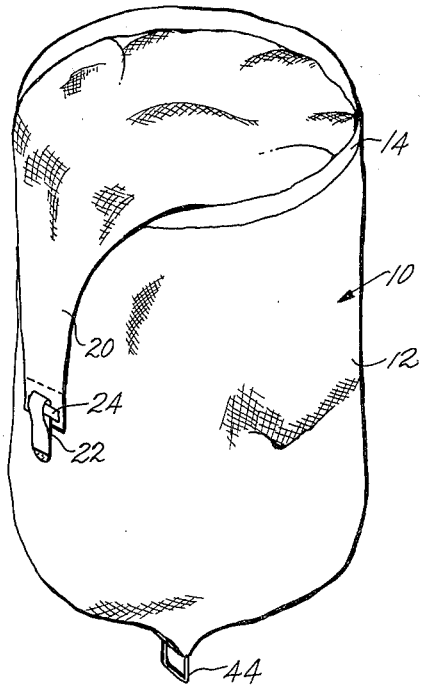
FIG. 2 is a view of the bag of FIG. 1 with the flaps secured in a closed position.

With initial reference to FIGS. 1 and 2, a laundry bag 10 of standard material, such as canvas, has a body 12 for holding laundry. The body of the bag is formed by folding material over onto itself and seaming it along the bottom and one side. A perimetric band 14 at the top of the body of the bag is sewn to the top of the body along a circumferencial seam 16. A pair of flaps 18 and 20 are also joined to the body of the bag at this seam. Flap 18 is for directly overlying laundry and flap 20 is to overlie flap 18 and to securely close the bag.

Bag closure is through a hook and pile fastener on a strap 22 attached to the body of the bag and a strap 24 on flap 20. As shown in FIG. 2, the free end of the strap is brought through strap 24 and attached on the fixed end of the strap to secure flap 20 in place.

Flaps 18 and 20 also include and are integral with side panels 26 and 28. These side panels also overlie laundry and help to keep it in place. They also perform an important function in holding the laundry bag to the laundry hamper, as will be subsequently described.

Thus flaps 18 and 20 are in opposition and generally orthogonal to side panels 26 and 28 which are also disposed in opposition to each other.

Figure 3:
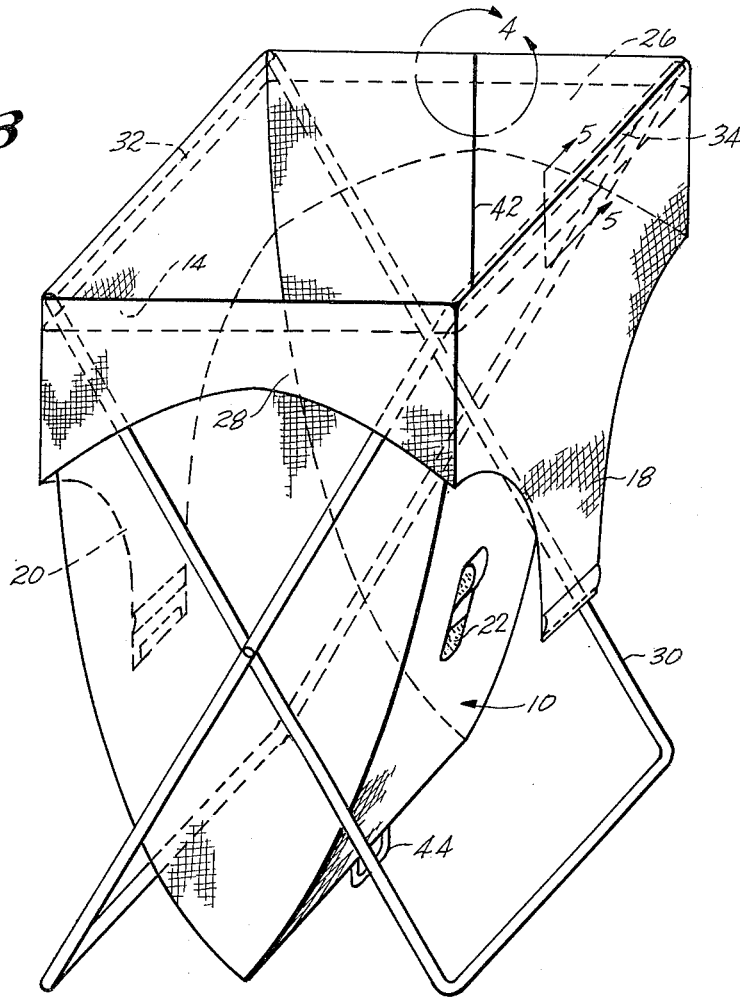
FIG. 3 is a perspective view of the bag of FIG. 1 on an X-frame laundry hamper.
Figure 4:
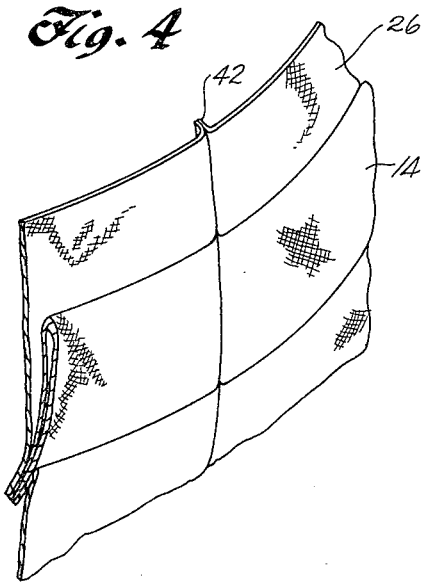
FIG. 4 is a fragmentary view of the seam construction of the bag in the area 4—4 of FIG. 3 but with the bag flaps extended upwards.
Figure 5:
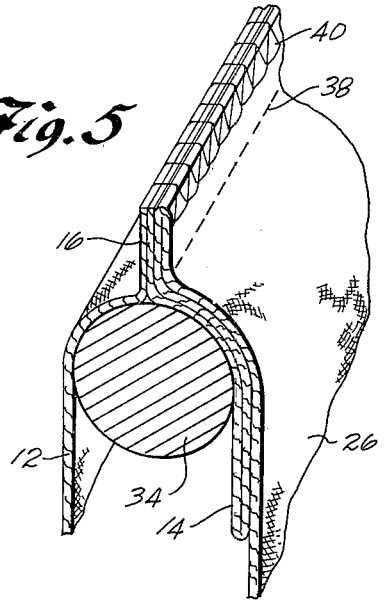
FIG. 5 is a fragmentary view taken generally along line 5—5 of FIG. 3.

With reference to FIG. 3, a standard X-frame laundry hamper 30 has a pair of upper cross bars 32 and 34 which support bag 10. In FIG. 3, bag 10 is illustrated open and supported by hamper 30. Side panels 26 and 28, and flaps 18 and 20 extend down the outside of the hamper. The extension is from the seam line of joinder of the flaps and panels to the body of the bag. The seam line forms a natural fold and therefore can determine the volume of the bag which receives laundry when the bag is used with a hamper. Augmenting this natural fold is band 14. As seen in FIGS. 4 and 5, band 14 is formed of doubled-over material formed of panels 26 and 28, and the two flaps. Band 14 helps define the fold line and in addition provides a reinforcing band to stiffen and strengthen the bag in the zones where the largest stresses are put on it, namely, at cross bars 32 and 34.

With reference to FIG. 5, the construction of seam 16 is shown in greater detail. The detail of cooperation of the bag with a cross bar is also illustrated. The upper edge of the body of bag 10 is sewn in the standard manner to material of the two flaps and side panels, side panel 26 being shown in FIG. 5. This joinder is at seam 16. The material of panel 26 begins adjacent to and in contact with the edge of the material of body 12 and extends for a length and doubles back upon itself a first time. This doubled-over portion defines band 14. The material is doubled over itself a second time, this time in seam 16, to provide the material for the side panels and flaps. In FIG. 5 the seam is shown sewn together by a standard stitching 38 and overcast stitching 40.

In FIG. 4 a portion of the longitudinal side seam joining the material of the body of the bag together to form the bag is shown at 42. Band 14 is shown secured in this side seam. In FIG. 4, as well, seam orientation of the bag fully open and the flaps drawn upwardly from the body of the bag is illustrated.

Incidental details of the construction include a handling strap 44 at the bottom of the bag to aid in emptying the contents of it, shown in FIGS. 2 and 4. An invoice pocket 46 may be provided on upper flap 20, shown in FIG. 1.

The present invention has been described with reference to a preferred embodiment. The spirit and scope of the appended claims should not, however, necessarily be limited to the foregoing description.

What is claimed is:

1. An improved laundry bag comprising:

a. a body of flexible material closed at its bottom and sides and open at its top;

b. a pair of flexible opposed, free flaps attached to the body only at its top, a first of these flaps for overlying laundry and a second for overlying the first; and c. means to secure the second flap to the body of the laundry bag to close the open end thereof, the securing means including a first strap affixed to the body, the first strap having hook and pile type fastener means and a free end, and a second strap secured to the second flap at both ends of the second strap, the middle of the second strap being free of the second flap, the second strap being positioned to pass the free end of the first strap and to secure the second flap closed when the first strap is fastened onto itself around the second strap with the fastener means, the first flap overlies laundry, and the second flap overlies the first flap.

2. The improved laundry bag claimed in claim 1 including side panels of the flaps and extending from the open end of the bag above the attachment of the flaps to the body, the side panels being for cooperating with the flaps in overlying laundry and closing the end of the bag.

3. The improved laundry bag claimed in claim 1 wherein the flaps are secured to the body along a circumferential seam at the open end of the body.

4. The improved laundry bag claimed in claim 1 including a band extending from the seam to reinforce the laundry bag at the seam and to help define thereat a natural fold for positioning the laundry bag on a laundry hamper.

5. The improved laundry bag claimed in claim 1 wherein the band is integrally formed with the flaps and including side panels of the flaps in diametric opposition to each other and generally orthogonal to the flaps, the side panels extending from the seam a distance shorter than the extension of the flaps but greater than the extension of the band.

6. The improved laundry bag claimed in claim 1 including a side seam on the body, the band being secured in the side seam in addition to its securement at the seam joining the flaps at the body.

7. The improved laundry bag claimed in claim 5 wherein the width of each of the flaps narrows away from the attachment thereof to the body.

8. The improved laundry bag claimed in claim 1 wherein the width of each of the flaps narrows away from the attachment thereof to the body.

* * * * *

UNITED STATES PATENT AND TRADEMARK OFFICE

CERTIFICATE OF CORRECTION

PATENT NO. : 3,943,988

DATED : March 16, 1976

INVENTOR(S) : Sebastian John Consorti

It is certified that error appears in the above-identified patent and that said Letters Patent are hereby corrected as shown below:

In the claims:

Column 4, line 12, claim 4 should depend on claim 3.
Column 4, line 16, claim 5 should depend on claim 4.
Column 4, line 24, claim 6 should depend on claim 5.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*